United States Patent [19]

Fujio

[11] 4,245,452

[45] Jan. 20, 1981

[54] METHOD AND APPARATUS FOR WRAPPING AN OBJECT IN A SHEET

[75] Inventor: Masaaki Fujio, Suita, Japan

[73] Assignee: Fuji Seal Industry Co., Ltd., Osaka, Japan

[21] Appl. No.: 50,763

[22] Filed: Jun. 21, 1979

[30] Foreign Application Priority Data

May 7, 1978 [JP] Japan ..... 53-81557

[51] Int. Cl.[3] ..... B65B 21/24

[52] U.S. Cl. ..... 53/399; 53/586; 53/234; 156/492

[58] Field of Search ..... 53/399, 410, 586, 139.3, 53/234; 156/475, 483, 484, 485, 488, 492

[56] References Cited

U.S. PATENT DOCUMENTS

| | | | |
|---|---|---|---|
| 3,056,246 | 10/1962 | Lyon et al. | 53/234 X |
| 3,176,442 | 4/1965 | Ganz . | |
| 3,248,847 | 5/1966 | Niepmann et al. | 53/234 X |
| 3,643,796 | 2/1972 | Arneson . | |

*Primary Examiner*—Travis S. McGehee

*Attorney, Agent, or Firm*—Lackenbach, Lilling & Siegel

[57] ABSTRACT

A method and apparatus are disclosed for wrapping an object in a sheet. A retainer formed with a slot is moved along a work path. A piece of sheet is supplied across the opening of the slot; then the object is inserted into the slot and pushes the sheet to the back of the slot against the retainer, with the edges of the sheet sticking out between the object and the edges of the slot, with part of the surface of the object being free; then a pressure plate is placed adjacent to the free surface, the outward facing surface of this plate being smooth; then first one, and then the other, protruding edge of the sheet is wrapped round the object and over the pressure plate by an embracing arm, so that the edges of the sheet overlap; then these edges are joined by a joiner bearing against the smooth part of the pressure plate; and then the wrapped object is discharged from the retainer.

8 Claims, 6 Drawing Figures

METHOD AND APPARATUS FOR WRAPPING AN OBJECT IN A SHEET

BACKGROUND OF THE INVENTION

The present invention relates to a method and an apparatus for wrapping objects in sheets.

It has been widely practiced to roll on protective sheets or films onto containers or the like, for the purposes of protection or decoration. It has also been practiced to roll on such sheets around the necks and caps of containers so as to reinforce the seal thereof.

Most apparatuses for performing such rolling on have been only usable for containers or other objects which have a simple cylindrical shape. When the object to be wrapped has had a complicated or irregular shape, these apparatuses have had limited applicability. Especially, in such cases, the sealing together of the edges of the film sheet where they meet has been imperfect, due to a lack of proper backing to resist the operation of a sealing machine.

SUMMARY OF THE INVENTION

Therefore, it is the object of the present invention to provide a method and an apparatus for wrapping objects which may have an irregular form.

According to the present invention, this object is attained by an apparatus for automatically wrapping an object in a sheet, comprising: a retainer formed with a slot, which moves along a work path; a pressure plate and a first and second wrapping arm, which move with the retainer; a sheet supply unit, an object charging unit, a joiner, and an object discharging unit, arranged in the specified order along the work path; and means for moving the pressure plate, the first wrapping arm, and the second wrapping arm, which operate automatically as the retainer reaches predetermined positions in its work path; wherein, as the retainer moves along the work path, in the specified order, the following events occur: (a) the sheet supply unit supplies the sheet so that it is located across the opening of the slot; (b) the object charging unit charges the object into the slot so that it pushes the sheet to the back of the slot, with a part of the sheet protruding on each side of the object, between it and that side of the slot; and so that a part of the surface of the object is free; (c) the means for moving the pressure plate moves it so that it is adjacent to the free part of the surface of the object, with the part of the surface of the pressure plate remote from the object being smooth; (d) the moving means for moving the first wrapping arm moves it so that it wraps one side of the sheet which projects on one side of the object, between it and that side of the slot, around the object and around the smooth part of the pressure plate; (e) the moving means for moving the second wrapping arm moves it so that it wraps the other side of the sheet which projects on the other side of the object, between it and that side of the slot, around the object and around the smooth part of the pressure plate, so that this side of the sheet overlaps the part which was wrapped during event (d); (f) the joiner joins the overlapped parts of the sheet by bearing against the smooth part of the pressure plate; and (g) the object discharging unit discharges the object from the slot; and by a method for wrapping an object in a sheet, wherein a retainer formed with a slot is moved along a work path; a pressure plate and a first and second wrapping arm are moved with the retainer; wherein, as the retainer moves along the work path, in the specified order, the following operations are performed: (a) a sheet supply unit supplies the sheet so that it is located across the opening of the slot; (b) an object charging unit charges the object into the slot so that it pushes the sheet to the back of the slot, with a part of the sheet protruding on each side of the object, between it and that side of the slot; and so that a part of the surface of the object is free; (c) a means for moving the pressure plate moves it so that it is adjacent to the free part of the surface of the object, with the part of the surface of the pressure plate remote from the object being smooth; (d) a means for moving the first wrapping arm moves it so that it wraps one side of the sheet which projects on one side of the object, between it and that side of the slot, around the object and around the smooth side of the pressure plate; (e) a means for moving the second wrapping arm moves it so that it wraps the other side of the sheet which projects on the other side of the object, between it and that side of the slot, around the object and around the smooth part of the pressure plate, so that this side of the sheet overlaps the part which was wrapped during operation (d); (f) a joiner joins the overlapped parts of the sheet by bearing against the smooth part of the pressure plate; and (g) an object discharging unit discharges the object from the slot.

According to particular embodiments of the present invention, the method of joining of the edges of the sheet may be either by adhesive, in which case between steps (d) and (e) an adhesive applicator supplies adhesive onto the edge of the sheet which has been wrapped by the first wrapping arm around the smooth side of the pressure plate, and the joiner is a pressure roller unit which applies pressure to the overlapped edges of the sheet; or by plastic welding, in the case of a plastic sheet, in which case the joiner is a plastic welding unit which welds the overlapped edges of the sheet together. Further, according to a particular embodiment of the present invention, the pressure plate, after step (c), may be held against the object so as positively to hold it in the slot.

BRIEF DESCRIPTION OF THE DRAWINGS

The present invention will become more clearly understood from the following description of a preferred embodiment, when taken in conjunction with the appended drawings. It should be clearly understood, however, that the embodiment and the drawings are given for the purposes of illustration and explanation only, and are not to be taken as being in any way limitative of the present invention, whose scope is to be determined solely by the claims. In the drawings, like numbers denote like parts in the several figures; and:

DESCRIPTION OF THE PREFERRED EMBODIMENT

Figure 1:
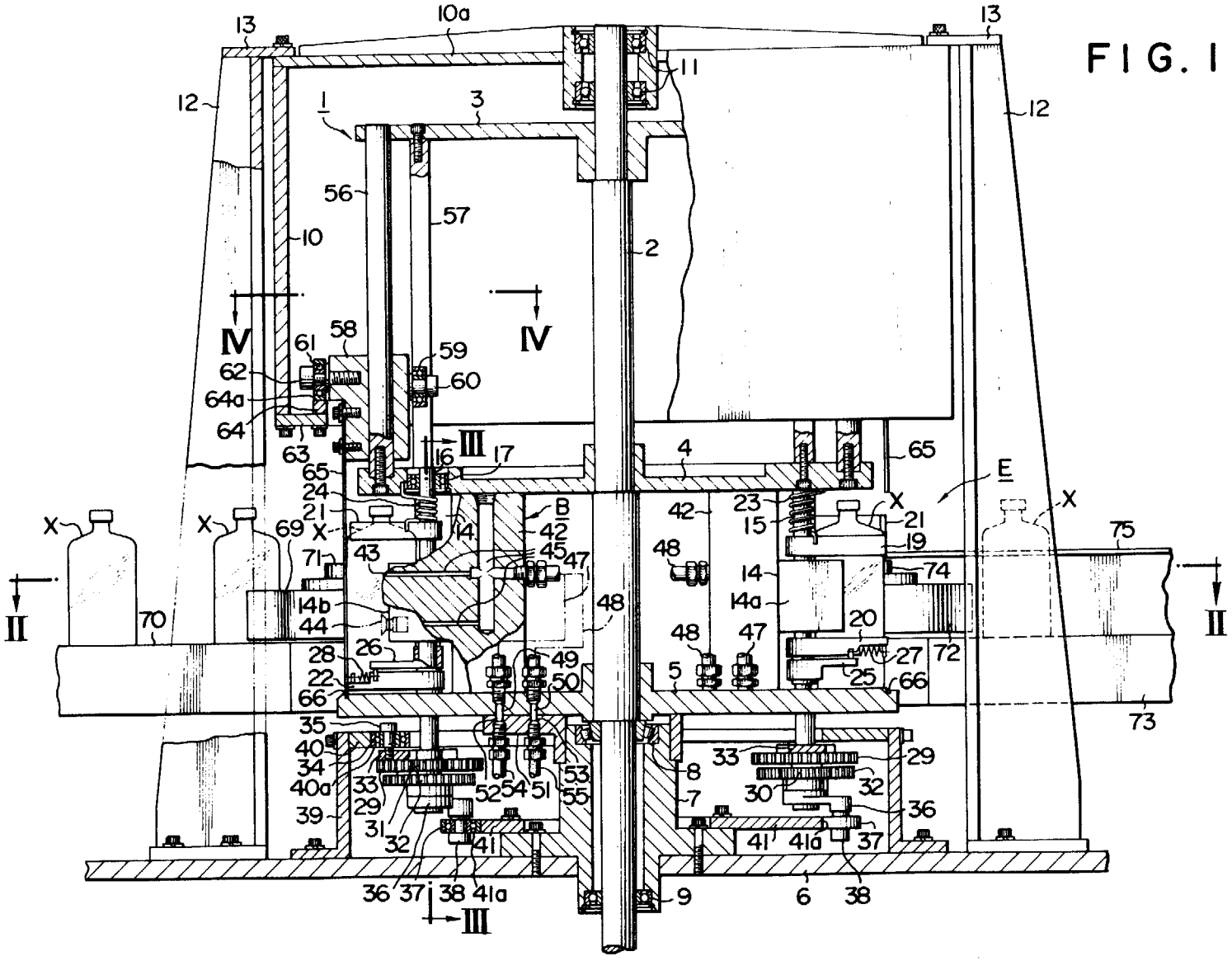
FIG. 1 is a partly cross-sectional and partly broken away front view of the embodiment of the present invention.

Referring to the drawings, a conveyor turn table 1 comprises a main shaft 2 extending generally vertically and a top table 3, a middle table 4, and a bottom table 5 mounted on the shaft.

The lower part of the shaft 2 is rotatably mounted in bearings 8 and 9 held within a collar 7 attached to the center of a bottom plate 6, and the top part of the shaft 2 is rotatably mounted in bearings 11 held within a top stop plate 10*a* of a cylindrical top plate 10. This top plate 10 is suspended from brackets 13 which are held by supporting columns 12 erected on the circumference of the bottom plate 6. The top plate 10 almost completely covers the upper part of the conveyor table 1.

The conveyor table 1 is rotated by drive means which are not shown in the drawings.

Between the middle table 4 and the bottom table 5 are mounted a plurality of wrapping units. In the shown embodiment there are six of these, and they are designated as A, B, C, D, E, and F. They are arranged at equal intervals around the main shaft 2. Since they are all identical, only unit B will be described.

Unit B comprises a container retainer 14, which will be hereinafter and in the claims referred to as a retainer, and which is mounted securely at its upper end to the lower surface of the middle table 4, and at its lower end to the upper surface of the bottom table 5. The retainer 14 is formed with a slot 14*c* suitable for receiving a container to be wrapped. In the shown embodiment this slot 14*c* is a part-circular depression. The sides of the retainer 14 on either side of the slot 14*c* form lateral ears 14*a* and 14*b*. The slot 14*c* extends generally vertically, so that it can receive a container supplied in a right-way-up orientation.

Figure 2:
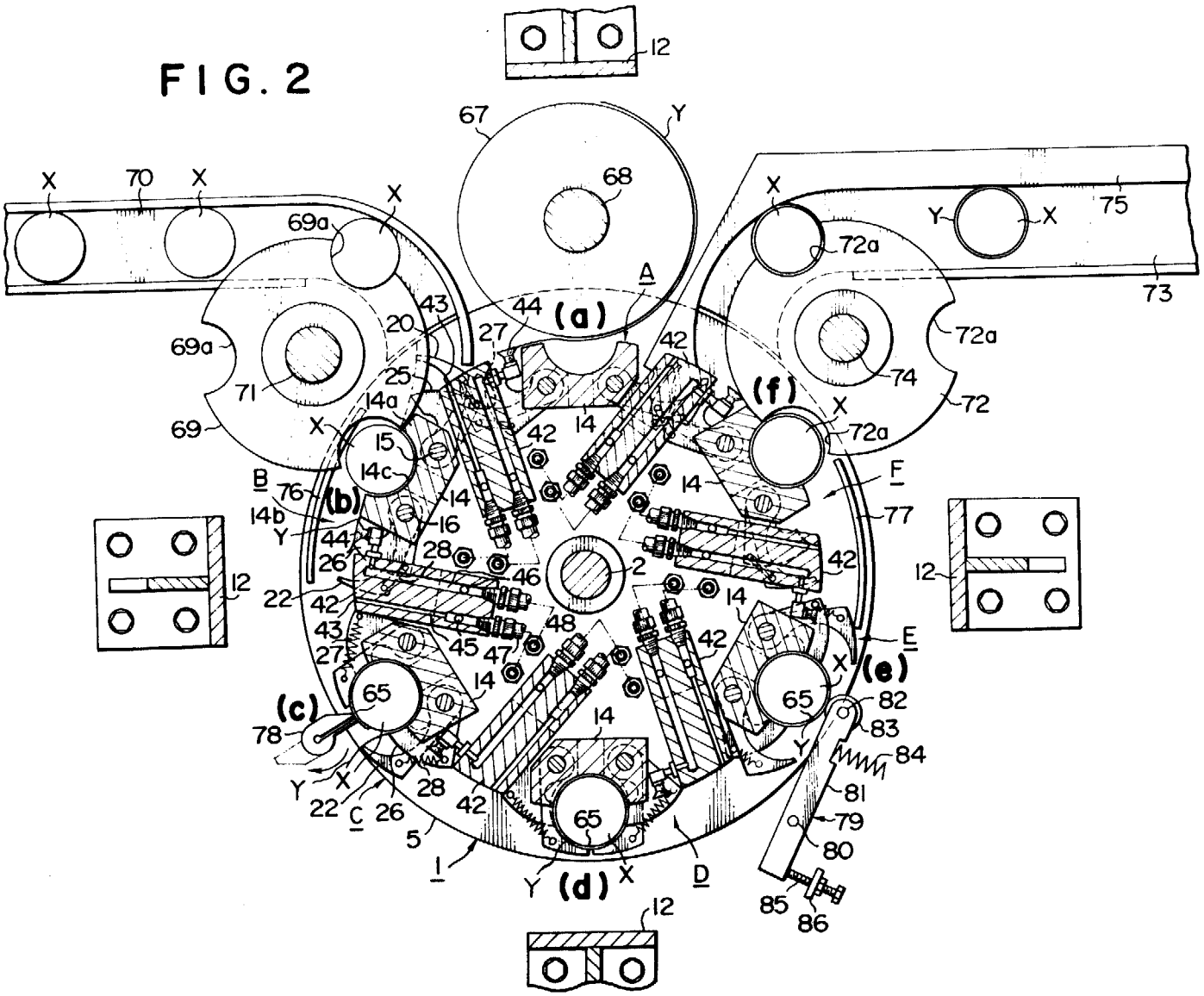
FIG. 2 is a cross-sectional view along the line II—II in FIG. 1.

A pair of vertical shafts 15 and 16 are pivotally inserted through the ears 14*a* and 14*b* of the retainer 14, and are carried in bearings 17 by the middle table 4 and in bearings 18 by the bottom table 5. Embracing arms 19 and 20 are securely mounted to the shaft 15, and embracing arms 21 and 22 are securely mounted to the shaft 16. As may be seen in FIG. 3, the arms 19 and 21 are on the upper portions of the shafts, and the arms 20 and 22 are on the lower portions. The arms 19 and 21 are slightly offset vertically from one another so that they do not interfere with one another, and so are the arms 20 and 22. The inner shape of each of these arms is generally part-circular, as may be seen in FIG. 2. Torsion coil springs 23 and 24 bias the shafts 15 and 16 in the directions to bring the embracing arms inwards. The upper ends of these coil springs are attached to the middle table 4, and the lower ends are attached to the arms 19 and 21, respectively.

Secondary arms 25 and 26 are fitted rotatably on the shafts 15 and 16 respectively; the secondary arm 25 between the arm 20 and the bottom table 5, and the secondary arm 25 between the arm 22 and the retainer 14. As may be seen in FIG. 2, tension coil springs 27 and 28 are stretched between points on the secondary arms 25 and 26 and points on the embracing arms 20 and 22, respectively, so that the secondary arms 25 and 26 are rotated around the shafts 15 and 16 and follow the pivotal motions of their corresponding embracing arms 20 and 22. The inner shape of the secondary arms 25 and 26 is generally part-circular, like that of the embracing arms, and is likewise adapted to the side contour of the object to be wrapped. The lengths in free condition of the springs 27 and 28, and the points to which they are fastened, are so arranged that, when the embracing arms are open and the secondary arms are free, the ends of the secondary arms are closer together than are the ends of the embracing arms, with respect to their angular position about the axes of the shafts 15 and 16.

Figure 3:
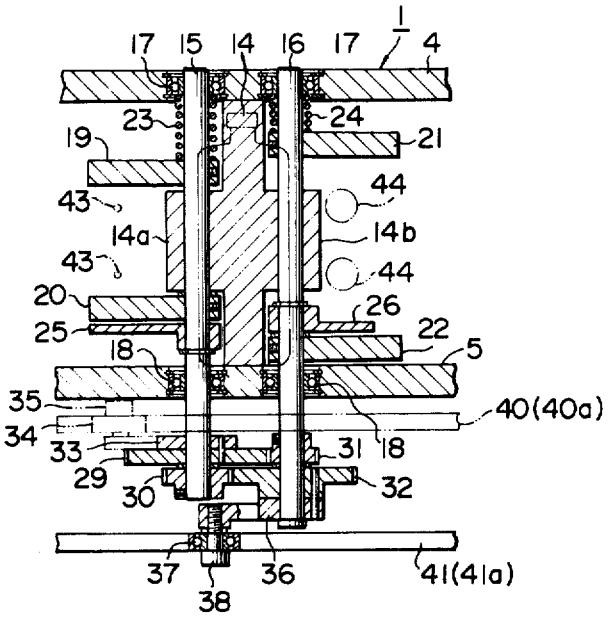
FIG. 3 is a cross-sectional view along the line III—III in FIG. 1.
Figure 4:
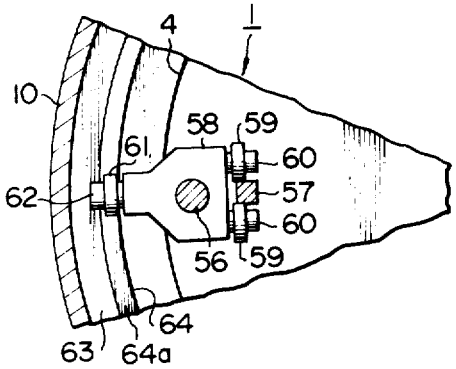
FIG. 4 is a plane cross-section along the line IV—IV in FIG. 1.

As may be seen in FIG. 3, on the lower ends of the shafts 15 and 16, where they protrude through the bottom table 5, are fitted gears 29 and 30, and 31 and 32, respectively. The gears 29 and 31 are meshed, as are the gears 30 and 32. The gears 29 and 32 are larger, and are rotatably mounted on their shafts, while the gears 30 and 31 are smaller, and are fixed to their shafts. To the gears 29 and 32 are fixed arms 33 and 36, and on the other ends of these arms are mounted rollers 34 and 37 by pins 35 and 38. These rollers 34 and 37 follow cam surfaces 40*a* and 41*a* of a cam ring 40 which is attached concentrically around the shaft 2 and a cam disk 41 rigidly attached to the collar 7. These cam surfaces are shown in development, i.e., unrolled, in FIG. 5. It will be easily seen that by the riding of the rollers on the cam surfaces the embracing arms may be moved in and out, bearing in mind that they are biased inwards by the torsion coil springs 23 and 24, as the table 1 rotates.

On both sides of the retainer 14 are fitted vacuum suction blocks 42. Each of these blocks is attached at its upper end to the lower surface of the middle table 4, and at its lower end to the upper surface of the bottom table 5. The middle part of each block 42 is provided with an outwardly extending projection 42*a* having a similar height to that of the lateral ears 14*a* and 14*b* of the retainer 14. On the right hand side (as seen from the outside of the machine) of each projection 42*a* are drilled two vacuum suction holes 43, and on the left hand side are fitted a pair of suction disks 44. The suction holes 43 and suction disks 44 are connected to vacuum passages 47 and 48 through connecting holes 45 and 46 drilled in the block 42. The passages 47 and 48 are connected to holes 49 and 50 drilled through the bottom table 5. These holes 49 and 50 are sometimes communicated to and sometimes cut off from part circular grooves 52 and 53 milled on the upper surface of a bottom plate 51, which is fixed to the collar 7 and is in close contact with the bottom table 5. These grooves 52 and 53 are connected to a vacuum suction apparatus not shown in the drawings. Thereby vacuum is supplied at the correct times to the holes 43 and disks 44, as desired, according to the configuration of the grooves 52 and 53.

The unit B is considered as comprising its retainer 14, its shafts 15 and 16, its embracing arms 19, 20, 21, and 22, its secondary arms 25 and 26, its gears 29, 30, 31, and 32, the holes 43 on the left of the retainer 14, and the disks 44 on the right of the retainer 14.

To each unit A–F corresponds a vertical guide post 57 of rectangular cross-section fixed between the top table 3 and the middle table 4, and parallel to each post 57 is a shaft 56. On the shaft 56 slides a slider 58, on whose inner side wall are mounted a pair of rollers 59 on pins 60, which roll on the guide post 57 up and down. A roller 61 is pivotally mounted on the outer side wall of the slider 58 by a pin 62 which is perpendicular to and intersects the axis of the main shaft 2. The roller 61 rides on and follows the cam surface 64*a*, which is the upper edge of a cylindrical cam 64 held concentrically with respect to the shaft 2 on the lower edge of the plate 10 by an attaching plate 63. The shape of the cam surface 64*a* may be seen in development in FIG. 5. Thereby, the slider 58 is raised and lowered along the shaft 56 and the post 57 in the desired timing.

To the lower edge of the slider 58 is attached a pressure plate 65 which projects downwards. The pressure plate 65 has an inner surface facing the axis of the table 1 which is generally of the same form as the largest cross-section of the object to be wrapped, and it has a smooth outside surface. When lowered, the lower edge of the plate 65 fits into a groove 66 milled in the upper edge of the bottom table 5. In this position the pressure plate 65 just fits around an object which is nestling in the slot 14*a* of the retainer 14, and exerts some pressure on it, so as to hold it in the slot. When the slider assumes its highest position, the bottom edge of the plate 65 is generally at the same level as that of the middle table 4.

A sheet supplying roller 67 is mounted beside the table 1 on a shaft 68, and consecutively supplies sheets of film Y made of plastic or the like, precut to an appropriate size, to the units A–F.

A container charging roller 69 is mounted beside the table 1 on a shaft 71, and is provided with slots 69*a* which, as the roller 69 rotates, pick up containers from a container path 70 and charge them into successive retainers 14 as the table 1 rotates.

The guide plate 75 is attached to the container discharging path 73 and projects in between the tables 4 and 5 so as to guide the containers out of their slots in the retainers 14 and discharge them, in cooperation with a container discharge roller 72 mounted on a shaft 74 which is provided with slots 72*a* for discharging the containers. The rollers 67, 69, and 72 are driven at appropriate speeds by drive means not shown in the drawing.

Guide plates 76 and 77 are provided as fixed to the frame of the machine around the table 1 between the tables 4 and 5, for a certain portion of their circumference, in order to stop containers falling out of the slots 14*a* of the retainers 14.

An adhesive supply unit 78 is arranged at the side of the table 1 and is controlled so that it supplies adhesive at an appropriate part of the cycle of the machine to attach together the edges of the sheet. The adhesive is applied to the left hand edge of the sheet, after it has been wrapped onto the pressure plate 65, and before the right hand edge of the sheet is wrapped thereonto.

A pressure roller unit 79 comprising a lever 81 mounted on a vertical shaft 80, a roller 83 mounted on the end of the lever 81 by a shaft 82, and a compression coil spring 84 which biases the lever 81, is arranged to press together the two edges of the sheet against the pressure plate 65. 85 is an adjusting screw mounted in a fixed plate 86.

Now the working of the machine shown will be described.

Considering the wrapping unit B as an example, first (considering the position just before the roller 67 as the start of the work path) film is supplied to the outer side of the retainer 14 by the roller 67, and is held there by the vacuum supplied to the holes 43 and disks 44. At this time the embracing and secondary arms are in the open position. This position is shown schematically in FIG. 5 by (a). At this time the pressure plate 65 is in the up position.

Figure 5:
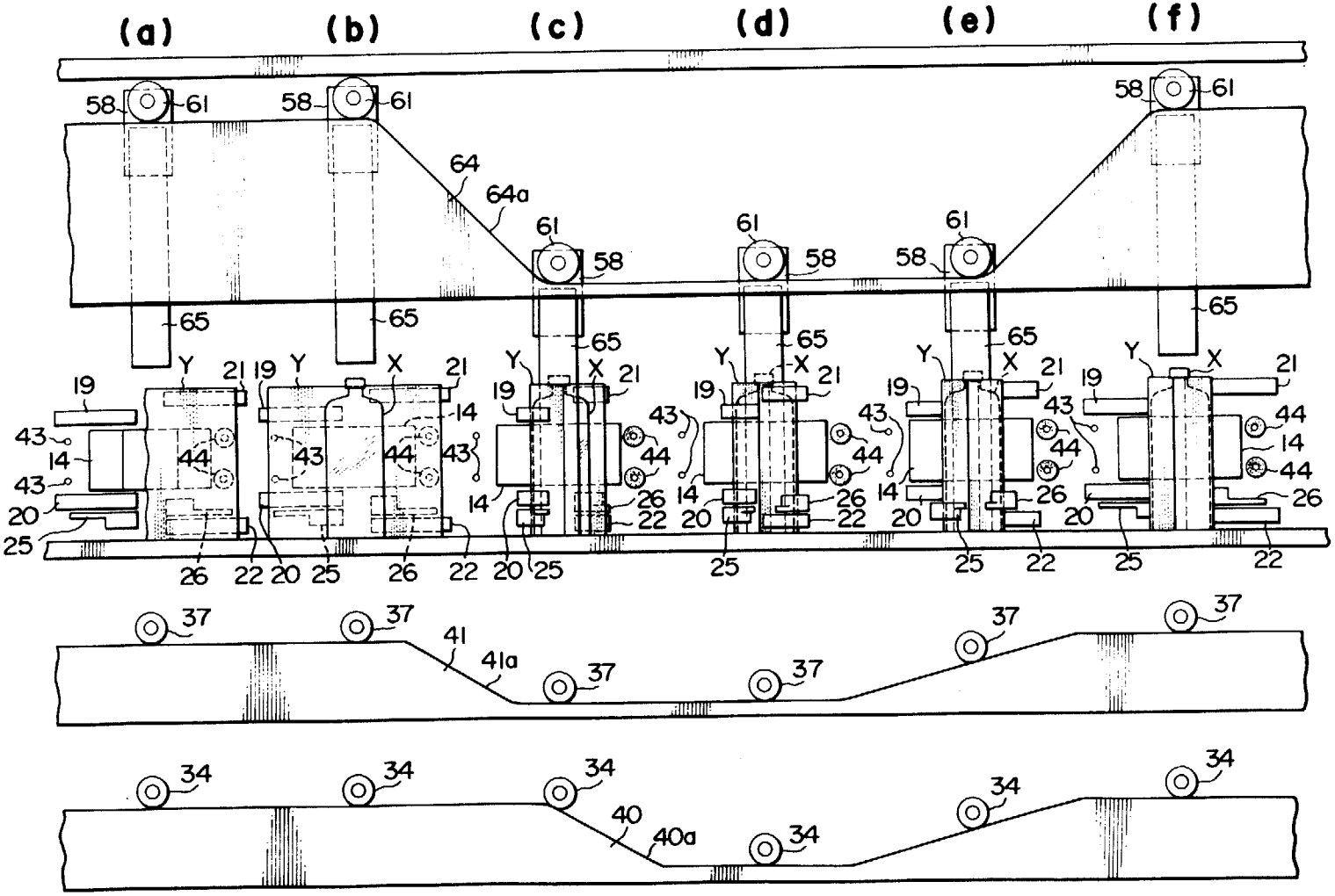
FIG. 5 is a schematic representation of certain parts of the machine shown in FIGS. 1-4, developed to illustrate their working.

Next, as the table 1 rotates in the counterclockwise direction in the figure, a container X is inserted into the slot 14*a* of the retainer 14. As it enters the slot, it pushes the film sheet to the back of the slot, against the retainer 14, with the edges of the film sheet sticking out between the container and the ears 14*a* and 14*b* of the retainer. This is shown in FIG. 5 as position (b). The outer facing side of the container is of course free.

While this happens the sheet slides over the holes 43 and disks 44, but since vacuum is applied thereto, there is no risk of the sheet falling off.

As the unit moves from position (b) to position (c), the pressure plate 65 moves down, and comes into contact with the outward facing free side of the container. The outward facing side of the pressure plate is smooth. Also the shaft 15 is rotated by the action of the spring 23 and the cam arrangement 37, 41*a*, etc., so that the secondary arm 25, first, and then the embracing arms 19 and 20, roll the left edge of the film around the side wall of the container, and onto the externally facing smooth surface of the pressure plate 65.

At this position (c) the adhesive supplying unit 78 supplies adhesive to this left edge of the film sheet, as it rests against the pressure plate 65.

As the unit moves from position (c) to position (d), the secondary arm 26, first, and then the embracing arms 21 and 22, wrap the right hand edge of the film onto the container and the pressure plate, and hold it overlapping the left hand edge, against the pressure plate 65.

As the unit moves from the position (d) to position (e), the embracing arms open up slightly, but the secondary arms continue to hold the sheet around the container, by virtue of the shallow slope seen in FIG. 5 of the cam surfaces 40*a*, 41*a*. At position (e), the roller 83 presses together firmly the two edges of the film, against the smooth surface of the pressure plate 65, and thus they are bound together.

As the unit moves from the position (e) to the position (f), the embracing arms and secondary arms open up, and the pressure plate 65 moves upwards. At position (f) the container is discharged from the retainer 14 along the path 73.

The cycle then repeats.

It will be seen, according to the foregoing, that the two edges of the film are joined by pressing them together, not against the possibly irregular wall of the container, but against the pressure plate 65. Thus irregular containers, or containers which have a surface of a non-developable form, may be wrapped.

According to a particular feature of the present invention, the pressure plate 65 may be adjusted to press against the container, so as positively to hold it in the slot 14*a* of the retainer. This is why the guide plates 76 and 77 need not be provided around most of the periphery of the work path.

According to the present invention, the method for joining the edges of the film need not be by adhesive, but could be by a heater, a microwave unit, or an ultrasonic unit for welding the edges together by fusion welding. In this case, of course no adhesive applicator is provided. The welder operates against the backing of the pressure plate 65, as before.

The conveyor table could be a linear one instead of a circular one.

Figure 6:
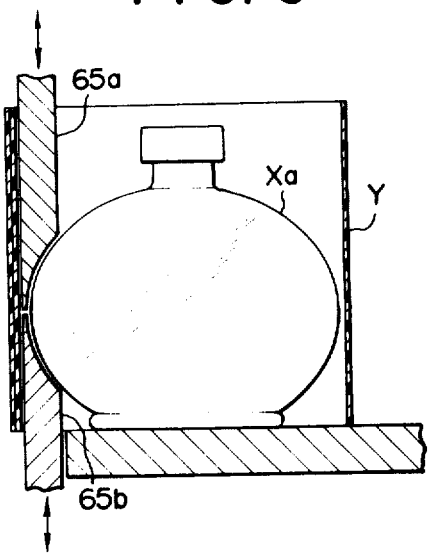
FIG. 6 is a sketch, schematically showing in section the arrangement of an alternative embodiment of the present invention, wherein two pressure plates are provided.

If the center of the container bulges, as shown in FIG. 6, the pressure plate 65 may be formed as two plates. The modifications necessary to the apparatus for moving these pressure plates will be obvious to one skilled in the art, based upon the foregoing disclosure.

Although the invention has been shown and described with reference to a particular preferred embodiment thereof, it should be understood that a person skilled in the art may make various changes to the form and the content of any particular embodiment, without departing from the scope of the present invention, which it is therefore desired should be delimited solely by the appended claims.

I claim:

1. An apparatus which automatically wraps an object in a sheet, comprising:

a retainer formed with a slot, which moves along a work path;

a pressure plate and a first and second wrapping arm, which move with the retainer;

a sheet supply unit, an object charging unit, a joiner, and an object discharging unit, arranged in the specified order along the work path;

and means for moving the pressure plate, the first wrapping arm, and the second wrapping arm, which operate automatically as the retainer reaches predetermined positions in its work path;

wherein, as the retainer moves along the work path, in the specified order, the following events occur:

(a) the sheet supply unit supplies the sheet so that it is located across the opening of the slot;

(b) the object charging unit charges the object into the slot so that it pushes the sheet to the back of the slot, with a part of the sheet protruding on each side of the object, between it and that side of the slot; and so that a part of the surface of the object is free;

(c) the means for moving the pressure plate moves it so that it is adjacent to the free part of the surface of the object, with the part of the surface of the pressure plate remote from the object being smooth;

(d) the moving means for moving the first wrapping arm moves it so that it wraps one side of the sheet which projects on one side of the object, between it and that side of the slot, around the object and around the smooth part of the pressure plate;

(e) the moving means for moving the second wrapping arm moves it so that it wraps the other side of the sheet which projects on the other side of the object, between it and that side of the slot, around the object and around the smooth part of the pressure plate, so that this side of the sheet overlaps the part which was wrapped during event (d);

(f) the joiner joins the overlapped parts of the sheet by bearing against the smooth part of the pressure plate; and (g) the object discharging unit discharges the object from the slot.

2. An apparatus according to claim 1, further comprising an adhesive applicator which is automatically controlled to supply adhesive, after event (d) and before event (e), onto the edge of the sheet which has been wrapped by the first wrapping arm around the smooth side of the pressure plate, wherein the joiner is a pressure roller unit.

3. An apparatus according to claim 1, wherein the joiner is a plastic welding unit.

4. An apparatus according to claim 1, 2, or 3, wherein the pressure plate, after step (c), is held against the object so as positively to hold it in the slot.

5. A method for wrapping an object in a sheet, wherein:

a retainer formed with a slot is moved along a work path;

a pressure plate and a first and second wrapping arm are moved with the retainer;

wherein, as the retainer moves along the work path, in the specified order, the following operations are performed:

(a) a sheet supply unit supplies the sheet so that it is located across the opening of the slot;

(b) an object charging unit charges the object into the slot so that it pushes the sheet to the back of the slot, with a part of the sheet protruding on each side of the object, between it and that side of the slot; and so that a part of the surface of the object is free;

(c) a means for moving the pressure plate moves it so that it is adjacent to the free part of the surface of the object, with the part of the surface of the pressure plate remote from the object being smooth;

(d) a means for moving the first wrapping arm moves it so that it wraps one side of the sheet which projects on one side of the object, between it and that side of the slot, around the object and around the smooth part of the pressure plate;

(e) a means for moving the second wrapping arm moves it so that it wraps the other side of the sheet which projects on the other side of the object, between it and that side of the slot, around the object and around the smooth part of the pressure plate, so that this side of the sheet overlaps the part which was wrapped during operation (d);

(f) a joiner joins the overlapped parts of the sheet by bearing against the smooth part of the pressure plate; and (g) an object discharging unit discharges the object from the slot.

6. A method according to claim 5, wherein after operation (d) and before operation (e) an adhesive applicator supplies adhesive onto the edge of the sheet which has been wrapped by the first wrapping arm around the smooth side of the pressure plate, and wherein the joiner is a pressure roller unit which applies pressure to the overlapped edges of the sheet.

7. A method according to claim 5, wherein the joiner is a plastic welding unit which welds the overlapped edges of the sheet together.

8. A method according to claim 5, 6, or 7, wherein the pressure plate, after step (c), is held against the object so as positively to hold it in the slot.

* * * * *